United States Patent [19]

Welden

[11] Patent Number: 4,614,491

[45] Date of Patent: Sep. 30, 1986

[54] MULTIPLE BURNER CONTROL APPARATUS

[76] Inventor: David P. Welden, N. Indiana Ave., Iowa Falls, Iowa 50126

[21] Appl. No.: 785,217

[22] Filed: Oct. 7, 1985

[51] Int. Cl.[4] ..... F23Q 9/08

[52] U.S. Cl. ..... 431/60; 431/285; 431/86; 431/281

[58] Field of Search ..... 431/12, 86, 89, 285, 431/281, 62, 60, 202; 236/1 EA

[56] References Cited

U.S. PATENT DOCUMENTS

| | | | |
|---|---|---|---|
| 1,689,803 | 10/1928 | Schroeder . | |
| 2,127,445 | 8/1938 | Hardgrove . | |
| 2,373,189 | 4/1945 | Klein . | |
| 2,390,806 | 12/1945 | Nagel . | |
| 2,411,642 | 11/1946 | Strobel . | |
| 2,479,797 | 8/1949 | Wasser . | |
| 2,549,633 | 4/1951 | Ottmar . | |
| 3,135,314 | 6/1964 | Brunner . | |
| 3,265,114 | 8/1966 | Childree . | |
| 3,694,137 | 9/1972 | Fichter et al. | 431/60 X |
| 3,749,546 | 7/1973 | Reed et al. | 431/285 X |
| 3,907,488 | 9/1975 | Takahashi et al. | 431/285 X |
| 4,252,300 | 2/1981 | Herder . | |
| 4,255,120 | 3/1981 | Straitz | 431/202 |

FOREIGN PATENT DOCUMENTS

| | | | |
|---|---|---|---|
| 35243 | 4/1978 | Japan | 236/1 E |
| 505662 | 5/1939 | United Kingdom | 431/60 |

*Primary Examiner*—Randall L. Green

*Attorney, Agent, or Firm*—Henderson & Sturm

[57] ABSTRACT

A single blower/multiple burner control system including a burning chamber, having a plurality of burners disposed therein. An equal number of conduits extend from the burning chamber to a manifold being supplied with a constant supply of air under pressure. Each of the conduits receiving pressurized air has a fuel line which is connected at one end thereof to such corresponding air line and having the other end connected to a fuel manifold which is being supplied with a constant supply of fuel. Each of the fuel lines has an adjusting valve therein for adjusting the amount of fuel passing therethrough and each of the fuel lines also has a shut-off valve therein for permitting the fuel to be completely shut-off or to permit fuel to pass therethrough from the fuel manifold to the corresponding conduit leading to the corresponding burner. A control circuit is provided so that once the first burner is ignited with less than a certain quantity of fuel, a time delay relay mechanism opens a fuel valve in a second fuel line after a predetermined amount of time has passed, whereby the second burner will ignite from the flame of the first burner. The number of air conduit lines and fuel conduit lines to be utilized will depend upon the requirements for heat in the burning chamber.

2 Claims, 4 Drawing Figures

MULTIPLE BURNER CONTROL APPARATUS

TECHNICAL FIELD

The present invention relates generally to gas burners and more particularly to a single blower and multiple burner apparatus using pre-mixed fuel and air.

BACKGROUND ART

Federal regulations prevent the use of a burner which ignites more than one million BTU's of fuel at one time. Consequently, if a burner utilizes more BTUs than that, then some other method must be utilized to comply with such Federal regulations. The reason for such a requirement is that if too much fuel is lit at one time, it is likely to explode the entire fuel chamber once it is lit. Consequently, certain motorized fuel valves have been utilized to light a low number of BTUs initially and then to increase the flow of fuel and air through such burner until such time that the needed BTUs are achieved.

While such a system is functional, it is not ideal and is more expensive and complicated to use than the situation where no motorized valves are required.

DISCLOSURE OF THE INVENTION

The present invention relates generally to a single blower/multiple burner control system including a burning chamber, having a plurality of burners disposed therein and having an equal number of conduits extending from the burning chamber to a manifold being supplied with a constant supply of air under pressure. Each of the conduits receiving pressurized air has a fuel line which is connected at one end thereof to such corresponding air line and having the other end connected to a fuel manifold which is being supplied with a constant supply of fuel. Each of the fuel lines has an adjusting valve therein for adjusting the amount of fuel passing therethrough and each of the fuel lines also has a shut-off valve therein for permitting the fuel to be completely shut-off or to permit fuel to pass therethrough from the fuel manifold to the corresponding conduit leading to the corresponding burner. A control circuit is provided so that once the first burner is ignited with less than a predetermined amount of fuel, a time delay relay mechanism opens a fuel valve in a second fuel line after a predetermined amount of time has passed, whereby the second burner will ignite from the flame of the first burner. The number of burners and corresponding air conduit lines and fuel conduit lines to be utilized will depend upon the requirements for heat in the burning chamber.

The present invention relates to an improved control system for igniting and controlling a burning chamber.

Another object of the present invention is to provide an apparatus whereby a burning chamber can have a high capacity and still have a way to ignite the burning chamber to reduce the risk of explosion.

Another object of the present invention is to provide a burner with a high capacity while eliminating the need for a motorized valve control.

A still further object of the present invention is to provide a lighting system and control for a multiple burner apparatus which has a time delay circuit therein wherein after the first burner is ignited, other burners will be ignited after a predetermined amount of time so that not too much fuel is ignited at any one time.

Other objects, advantages, and novel features of the present invention will become apparent from the following detailed description of the invention when considered in conjunction with the accompanying drawings.

BEST MODE FOR CARRYING OUT THE INVENTION

Figure 1:
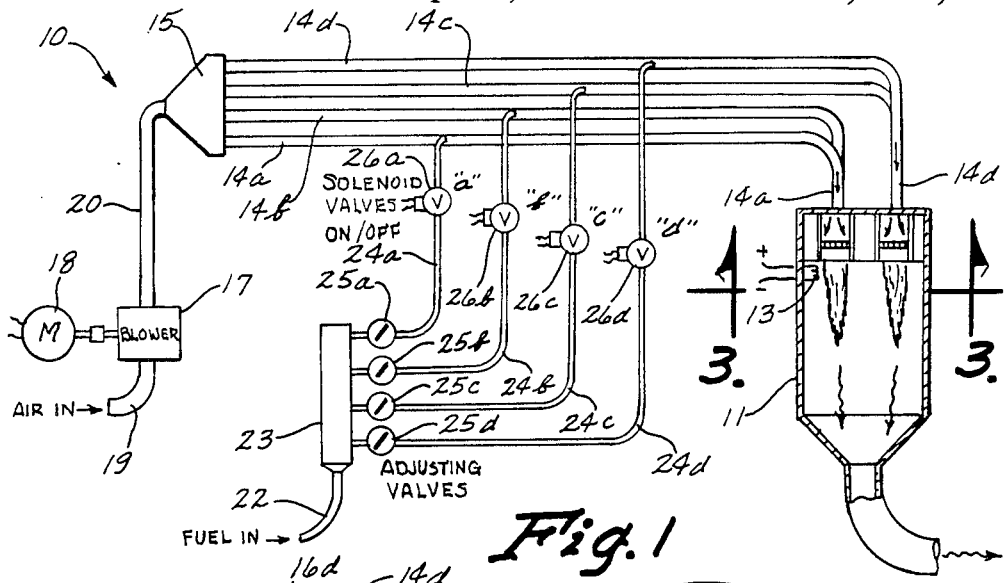
FIG. 1 shows a schematic view of a single blower/-multiple burner system using premixed fuel and air.
Figure 2:
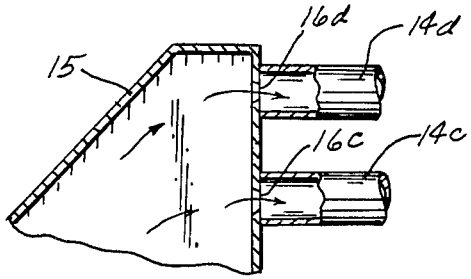
FIG. 2 is a partial enlarged cross sectional view of the manifold of the blower for blowing air into the system.
Figure 3:
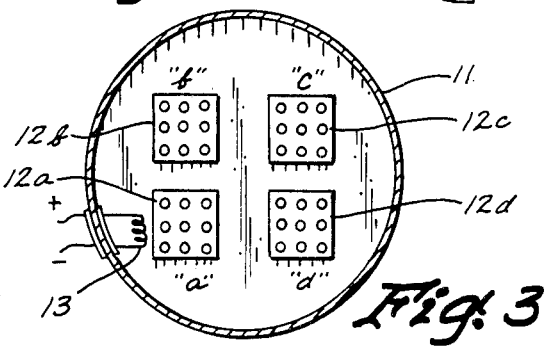
FIG. 3 is an enlarged cross sectional view taken along line 3—3 of FIG. 1.

Referring now to the drawings, wherein like reference numerals designate identical or corresponding parts throughout the several views, FIG. 1 shows a single blower/multiple burner system (10) using premixed fuel and air. FIGS. 1 and 3 show a burning chamber (11) having a plurality of burners (12*a*), (12*b*), (12*c*), and (12*d*), disposed therein. The burner (12*a*) has an igniter (13) attached adjacent thereto. The burner (12*a*) has a conduit (14*a*) in fluid communication therewith and the other end of the conduit (14*a*) is connected to an air manifold (15). Similarly, each of the other conduits (14*b*, 14*c* and 14*d*) interconnect the respective burners (12*b*–12*d*) with the manifold (15).

Each of the conduits (14*a*–14*d*) are interconnected with the manifold (15) through equal size openings (16*a*–16*d*) so that the pressurized air within the manifold (15) will cause equal amounts of air to pass through the burners (12*a*–12*d*).

A blower (17), run by a motor (18), will suck air in through an air inlet (19) and out through a conduit (20) to maintain the pressure within the manifold (15) at the desired level.

Referring again to FIG. 1, it is noted that a fuel supply line (22) supplies fuel under pressure to a fuel manifold (23). This fuel manifold (23) is interconnected with each one of the conduits (14*a*–14*d*) through respective fuel lines (24*a*, 24*b*, 24*c* and 24*d*). Each of the fuel lines (24*a*–24*d*) has an adjusting valve (25*a*, 25*b*, 25*c* and 25*d*) therein respectively, for the purpose of adjusting the amount of fuel that will pass through the fuel lines (24*a*–24*d*). These adjusting valves (24*a*–25*d*) can all be set to the same setting or they can be set at different settings if so desired. Also disposed within each of the fuel lines (24*a*–24*d*) are solenoid shut-off valves (26*a*, 26*b*, 26*c* and 26*d*), respectively. These shut-off valves are either on to allow flow through each of the fuel lines, or off to prevent such flow.

Figure 4:
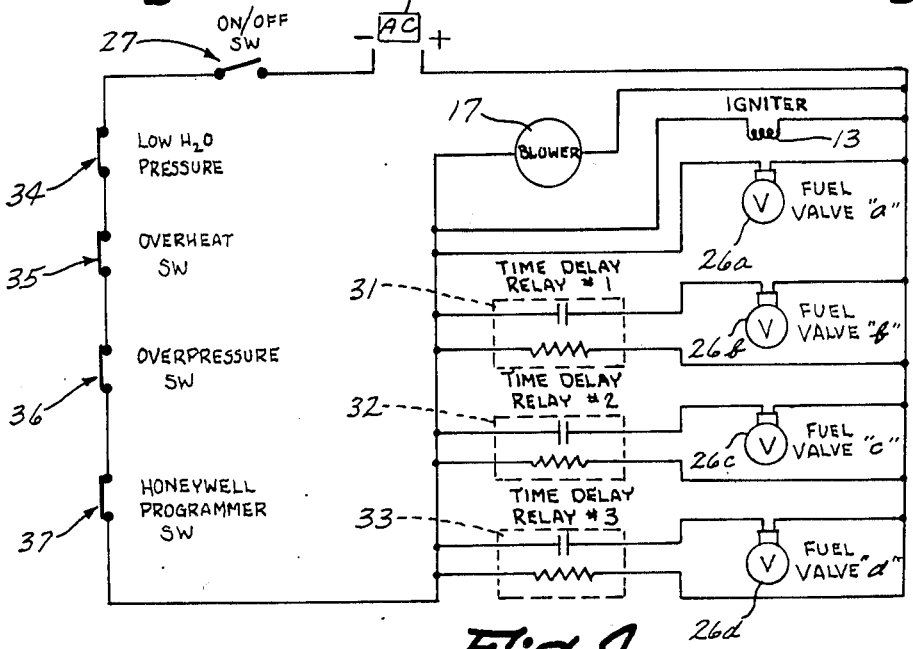
FIG. 4 is a simplified electrical schematic view of the control system for the preferred embodiment of the present invention.

Referring now to FIG. 4, it is noted that a circuit is shown for utilizing and controlling the invention shown in FIG. 1. When the on-off switch (27) is closed, the AC power source (28) will cause electricity to flow thorugh the circuit and cause the blower to start supplying air to the manifold (15) and ultimately to each of the burners (12*a*–12*d*) in equal amounts. At the same time, electricity will be supplied to the igniter (13) adjacent to burner (12*a*), and at the same time, the shut-off valve a will be opened by the action of the solenoid associated therewith.

Since both air and fluid will be passing out through the burner (12*a*), and the igniter (13) will be adjacent thereto, the burner (12*a*) will be lit. A time delay mechanism (31) will cause a predetermined amount of time to pass from the time that the switch (27) was closed and this will be a significant time from the time that the first burner (12) was lit. After such predetermined time delay, the second fuel valve will be opened because the time delay mechanism (31) will then supply electricity to the solenoid associated with the valve (26*b*). This will cause air and fuel to both pass through the burner (12*b*) and it will be lit because it is in close proximity to the flame of burner (12*a*).

The time delay relay (32) has a longer time delay associated therewith than the time delay relay (31) so that it will cause electricity to actuate the fuel valve (26*c*) only after both burners (12*a* and 12*b*) have been lit. After that, it will allow fuel to pass through the burner (12*c*) with the air through conduit (14*c*) and, because it is adjacent to the burner (12*b*), it will also ignite. Similarly, a time delay relay (33) is set to supply electricity to the solenoid valve (26*d*) only after a still further predetermined amount of time so that it will cause the burner (12*d*) to ignite only after burners (12*a*, 12*b* and 12*c*) have been lit in sequence.

Also, in the circuit of FIG. 4 is a low water pressure regulator switch (34) an over heat pressure switch (35) an over pressure switch (36) and a Honeywell R4795A programmer for purge air control and ultraviolet control, all of which are fairly standard in this art.

Obviously, many modifications and variations of the present invention are possible in light of the above teachings. It is therefore to be understood, within the scope of the appended claims, the invention may be practised otherwise than as specifically described.

I claim:

1. A multiple burner control apparatus comprising:

means for forming a burning chamber;

a first burner disposed in said burning chamber;

a second burner disposed in said burning chamber adjacent to said first burner;

a first conduit means connected at one end thereof to said first burner means;

a second conduit means connected at one end thereof to said second burner means;

means for forming an air manifold to interconnect the other ends of said first and second conduit means;

a blower means for blowing air;

a third conduit means for fluidly interconnecting said blower means to said air manifold means;

a first fuel line means fluidly connected at one end thereof to said first conduit means at a point upstream from said burning chamber;

a second fuel line means fluidly connected to said second conduit means at a point upstream from said burning chamber;

means for forming a fuel manifold to fluidly interconnect the other ends of said first and second fuel line means;

means for supplying fuel under pressure to said fuel manifold means;

first adjusting valve means disposed in said first fuel line means for adjusting the amount of fuel that will pass therethrough;

second adjusting valve means disposed in said second fuel line for adjusting the amount of fuel that will pass therethrough;

first shut-off valve means disposed in said first fuel line means for alternatively completely opening or completely closing said first fuel line means;

second shut-off valve means disposed in said second fuel line means for alternatively completely opening or completely closing said second fuel line means;

means disposed at least partially in said burning chamber for igniting a fuel air mixture passing out through said first burner; and electrical time delay relay means for automatically causing said second shut-off valve means to open at a predetermined time after said igniting means ignites said first burner independently of the pressure in said first and second fuel line means, whereby said second burner will be ignited by the flame from said first burner after said predetermined time has elapsed.

2. The apparatus of claim 1 including:

a third burner disposed in said burning chamber;

a fourth burner disposed in said burning chamber;

a third conduit connected at one end thereof to said third burner means and at the other end thereof to said air manifold means;

a fourth conduit connected at one end thereof to said fourth burner means and out the other end thereof to said air manifold means;

third fuel line means fluidly connected at one end thereof to said third conduit means and at the other end thereof to said fuel manifold means;

fourth fuel line means fluidly connected at one end thereof to said fourth conduit means and at the other end thereof to said fuel manifold means;

third adjusting valve means disposed in said third fuel line means for adjusting the amount of fuel that will pass therethrough;

fourth adjusting valve means disposed in said fourth fuel line means for adjusting the amount of fuel that will pass therethrough;

third shut-off valve means disposed in said third fuel line means for alternately completely opening or completely closing said third fuel line means;

fourth shut-off valve means disposed in said fourth fuel line means for alternately completely opening or closing said fourth fuel lines means;

second electrical time delay relay means for automatically causing said third shut-off valve means to open at a predetermined time after the opening of said second shut-off means whereby said third burner will be ignited by one or more of said first and second burners; and third electrical time delay relay means for automatically causing said fourth shut-off valve means to open at a predetermined time after the opening of said third shut-off means whereby said fourth burner will be ignited by the flame of one or more of the first, second and third burners.

* * * * *